US005742989A

United States Patent [19]

Subotsch

[11] Patent Number: 5,742,989

[45] Date of Patent: Apr. 28, 1998

[54] RIVET SETTING TOOL

[76] Inventor: Roman Subotsch, Am Heiligenhaus 30, D-65232 Taunusstein, Germany

[21] Appl. No.: 618,297

[22] Filed: Mar. 18, 1996

[30] Foreign Application Priority Data

Mar. 16, 1995 [DE] Germany ..... 295 04 316 U

[51] Int. Cl.[6] ..... B21J 15/22

[52] U.S. Cl. ..... 29/243.525; 29/243.523

[58] Field of Search ..... 29/243.523, 243.524, 29/243.529

[56] References Cited

U.S. PATENT DOCUMENTS

| | | | |
|---|---|---|---|
| 4,546,637 | 10/1985 | Elias | 29/243.523 |
| 4,580,435 | 4/1986 | Port et al. | 29/243.525 |
| 4,924,691 | 5/1990 | Summerlin et al. | 29/243.523 |
| 5,490,311 | 2/1996 | Rosier | 29/243.523 |
| 5,500,990 | 3/1996 | Wihan | 29/243.525 |

*Primary Examiner*—David Jones

[57] ABSTRACT

A rivet setting tool for setting blind rivets and/or pins with setting rings comprises an actuating assembly operable to impart an axial movement to the pulling pin for setting the rivet. The actuating assembly has a piston-cylinder arrangement comprising a pressure piston and a working piston movable in the direction for pulling the pulling pin during the rivet-setting operation by a substantially incompressible fluid pressurized by the pneumatically actuated pressure piston. The working piston is moved back in the opposite direction to the pulling direction after the setting operation. The escape of air from the pneumatic actuation assembly of the pressure piston in the return movement is promoted by a venting device. The flow resistance of a passage between the pressure piston and the working piston is different during movement in the pulling direction from that during the return movement.

14 Claims, 2 Drawing Sheets

RIVET SETTING TOOL

FIELD OF THE INVENTION

The invention concerns a rivet setting tool for setting a blind rivet member.

In this specification the term blind rivet member is used to denote any appropriate form of rivet or rivet-like member which is capable of being set or clinched from one side where the other side thereof is generally inaccessible, and therefore includes a blind or pop rivet in the narrow sense, a pin or stud with setting ring or the like, the blind rivet member having a pulling pin for setting thereof.

BACKGROUND OF THE INVENTION

One form of a rivet setting tool for setting a blind rivet member such as, as indicated, a blind rivet and/or pin with a setting ring, comprises an actuating means which is actuable for the rivet-upsetting operation and which imparts an axial movement to the pulling pin of the blind rivet member. The actuating means includes a piston-cylinder arrangement comprising a pressure piston and a working piston. The working piston, during the setting operation, is moved in the direction for pulling the pin of the blind rivet member by a substantially incompressible fluid which is put under pressure by the pressure piston which is actuated pneumatically. After the setting operation, the working piston is moved back in the opposite direction to the pulling direction, for example by a spring force or by compressed air.

A rivet setting tool of that kind is described for example in EP 0 236 464 B1. In that tool the return movement of the pressure piston and the working piston is produced by diverting compressed air to the rear sides of the pistons, thereby avoiding the need for return springs.

In another rivet setting tool as described in EP 0 302 128 B1, the working piston is moved back into its starting position by spring force after the rivet-setting operation. In that case the incompressible fluid which for example is in the form of hydraulic oil is displaced back by the working piston and consequently moves the pressure piston back into its starting position, for the next rivet-setting operation. A further rivet setting tool is to be found in DE 31 25 838 C2. Reference may be made to the above-discussed publications for more extensive understanding of the operating principles involved in such rivet setting tools.

SUMMARY OF THE INVENTION

An object of the present invention is to provide a rivet setting tool which operates reliably and satisfactorily and which permits the operating procedure to be performed at high speed.

Another object of the present invention is to provide a rivet setting tool which while being of a simple design configuration provides optimum results in terms of the mechanical fixing effect for the set rivet and which permits the rivet setting operation to be performed easily and quickly without operator stress.

Still a further object of the present invention is to provide a rivet setting tool which is readily capable of producing sound secure fixing of the blind rivet member when set without involving a complicated operating procedure on the part of the operator.

In accordance with the present invention the foregoing and other objects are attained by a rivet setting tool for setting a blind rivet member, comprising an advance or actuating means operable for a rivet-setting operation by imparting an axial movement to the pulling pin of the blind rivet member to be set. The actuating means includes a piston-cylinder means comprising a first cylinder, a pressure piston movable in the first cylinder, means for pneumatic actuation of the pressure piston, a second cylinder, a working piston movable in the second cylinder and adapted to be moved in the pulling direction for imparting said axial movement to the pulling pin during the setting operation by a substantially incompressible fluid which is put under pressure by the pressure piston, the working piston being adapted to be moved back in a return movement in the opposite direction to the pulling direction after the setting operation. The tool further includes a venting means for promoting the escape of air from the pneumatic actuation means for the pressure piston in the return movement.

It has been found that an almost 50% reduction in the amount of time required for a rivet setting operation can be achieved with a tool as set forth in the preceding paragraph. By virtue of the additional venting means in the tool the working piston, in its return movement, can substantially more easily discharge the compressed air from the cylinder of the pneumatic pressure piston associated therewith, so that an undesired build-up of pressure is avoided and the resistance of the pressure piston to release of the tool is considerably reduced.

In accordance with a preferred feature of the invention the venting means is operable to provide a direct communication between the pneumatic actuation means of the pressure piston and the exterior, during the return movement of the pressure piston and the working piston, so that the compressed air can leave the actuating means of the pressure piston over a short distance and with a very low level of resistance to the discharge flow thereof.

Another preferred feature of the invention provides that the venting means includes a valve body operable to close the communication with the exterior at a working pressure obtaining within the pneumatic actuating cylinder, and open said communication when the pressure value falls below a predeterminable pressure limit value. In that way it is possible entirely to eliminate an additional control system for controlling actuation of the venting means. Setting the predeterminable pressure limit value to a value which is below the respective working pressure involved affords an automatically operating venting means which is reliable in operation and which can be furnished as an independent operational assembly.

Preferably the valve body of the venting means is in the form of a ball arranged in an at least substantially cylindrical opening or recess in the main body portion of the venting means, at a defined spacing relative to the cylindrical wall of the recess. That arrangement reliably eliminates any tilting or jamming of the valve body, at any time, while the above-mentioned predeterminable pressure limit value can be established by virtue of the defined spacing relative to the cylindrical wall. The remaining internal passage cross-section between the valve body and the wall of the cylindrical recess substantially defines the flow resistance and thus also the dynamic pressure which is produced by the valve body and with which it is pressed against and closes an annular sealing surface at the bottom of the recess in the body portion of the venting means.

The predeterminable pressure limit value can also be predetermined by suitable selection of the spring constant or spring rate of a coil spring which acts on the valve body.

In accordance with another preferred feature of the invention, the tool includes adjoining the cylindrical opening or recess which accommodates the valve ball, a further at least substantially cylindrical opening or recess of smaller diameter, in which the coil spring is disposed. The coil spring can then preferable press the valve ball or body against a retainer such as a circlip arranged at the opposite end of the cylindrical recess or opening of larger diameter. The predeterminable pressure limit value and the effective flow resistance afforded by the venting means can be adjusted in a wide range by a suitable choice of the spring constant and the size of the valve ball or body. That arrangement also affords an extremely compact structure which is advantageous in terms of manufacturing procedure, by virtue of the possibility of using concentric bores to provide the openings or recesses.

A further preferred feature of the invention provides that the main body portion of the venting means has a screwthread and sealing surfaces which are associated therewith and by means of which the venting means can be fluid-tightly fixed to an opening to the cylinder of the pneumatic actuating piston. That arrangement also makes it possible for the venting means to be subsequently fitted to a conventional rivet setting tool.

In regard to a rivet setting tool, it was also found that, particularly when using setting rings, enhanced attention needs to be paid to the speed at which irreversible deformation of the setting ring occurs. If the operation of applying a pulling force is performed at a very high speed, that can in fact result in a mechanical connection which admittedly appears correct externally, but under some circumstances the strength values achieved only lie below the optimum desired result. Excessively rapid deformation of the ring can give rise to the formation of microcracks in the material structure, which, although without laying any claim to this explanation being totally correct and complete, are probably due to the fact that the metal structure did not have sufficient time for flowing or yielding deformation thereof and therefore the effects of forces occurring at grain boundaries promoted the occurrence of cracks or microcracks.

To deal with that problem, the flow resistance of a passage between the pressure piston and the working piston of the rivet setting tool according to the invention may be different during movement in the pulling direction, from the flow resistance during the return movement of the working piston.

That arrangement makes it possible to achieve a movement in the pulling direction which is matched in optimum fashion to the rivet setting operation, independently of a high speed for the return movement of the pressure and working pistons.

In a preferred form of that feature the variation in the flow resistance of the passage forming the communication between the pressure piston and the working piston can be achieved by means of a valve body operable to reduce the internal widths of the passage between the pressure piston and the working piston, during the pulling movement involved in the rivet setting operation.

The valve body is entrained by the movement of the hydraulic fluid and has self-adjusting properties if it has a frustoconical main body portion, with a cylindrical projection portion adjoining same. A bore passing centrally in the longitudinal direction through the main body portion of the valve body permits the desired setting of the flow resistance upon movement in the pulling direction, by virtue of a suitable choice of the diameter of the bore.

Arranging the valve body within the cylinder of the pressure piston, in front of the outlet opening thereof, with the valve body being held in a cylindrical opening or recess in a rectangular cage with an axial through bore, defines an upper and a lower limit position for the valve body. In the upper limit position, the through bore in the valve body acts as the effective internal width while in the lower limit position of the valve body, in contact against the rectangular cage, the full cross-section of the passage is available for the flow therethrough.

Further objects, features and advantages of the present invention will be apparent from the following description of a preferred embodiment thereof.

DESCRIPTION OF THE PREFERRED EMBODIMENT

Figure 1:
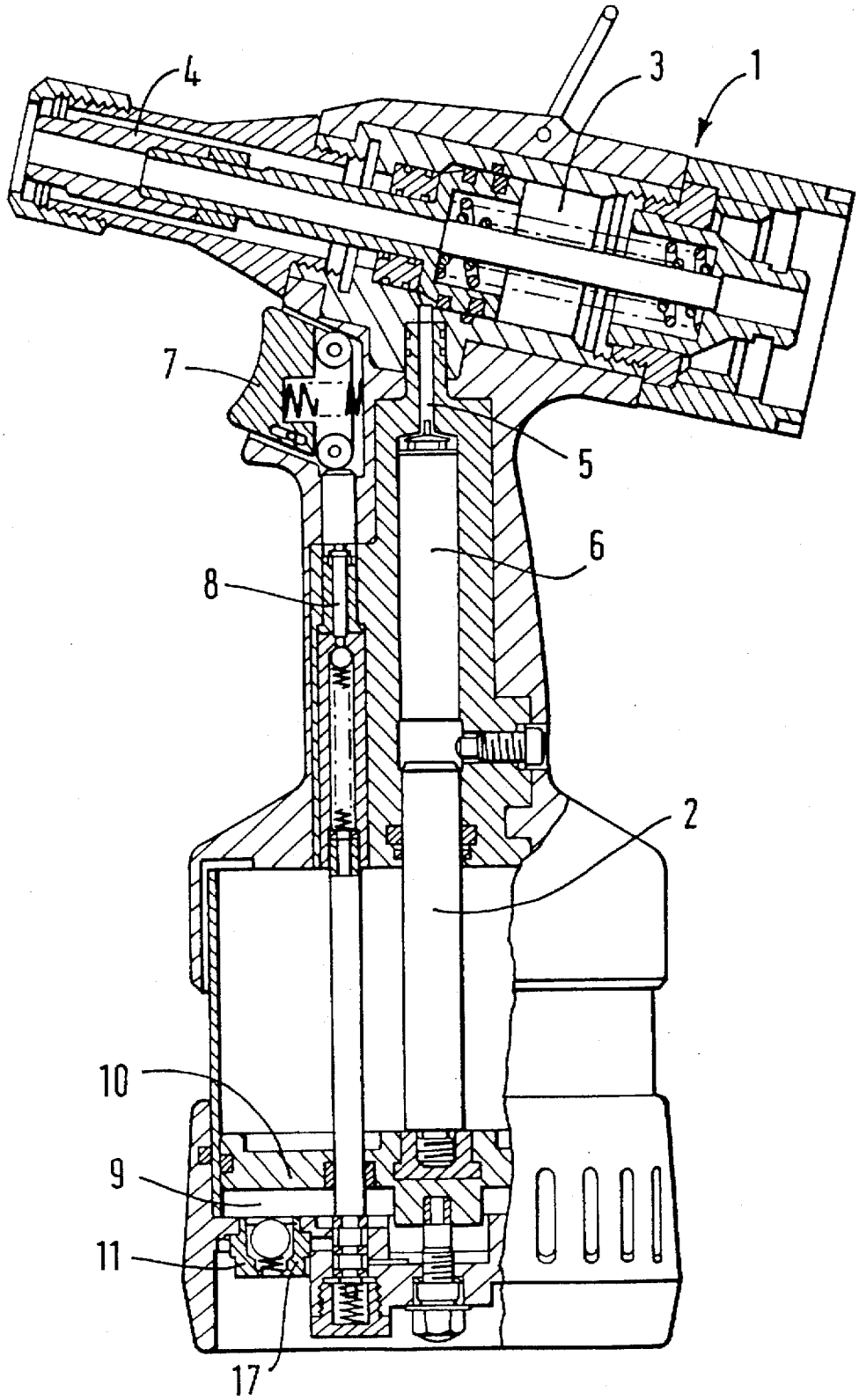
FIG. 1 is a partially cross-sectional view in a vertical direction of a rivet setting tool according to the invention approximately in the plane of the longitudinal axis of the pressure piston and the longitudinal axis of the working piston thereof.

Reference will firstly be made to FIG. 1 showing a rivet setting tool according to the invention, which is generally identified by reference numeral 1. The tool 1 includes a pressure piston 2 and a working piston 3.

The working piston 3 is provided with a receiving means or holder 4 for receiving the pulling pin of a blind rivet or the pulling pin of a pin member with a setting ring, for transmitting an actuating movement of the working piston 3 to the blind rivet or the pin member carried by the receiving means 4, for the rivet setting operation. The movement of the working piston 3 thus imparts an axial movement to the pulling pin of the blind rivet or the pin member to set the rivet.

In the pulling operation, actuation of the pressure piston 2 causes a substantially incompressible fluid, for example and preferably hydraulic oil, to be pressed out of the cylinder 6 which accommodates the pressure piston 2 through a communicating passage 5 into the cylinder accommodating the working piston 3. In that operation, by manual actuation of a trigger 7, by virtue of a change in the position of a valve rod 8, the pneumatic cylinder 9 which accommodates a pneumatically actuated piston 10 connected to the pressure piston 2 slidable in the cylinder 6 is substantially acted upon by a pneumatic actuating pressure.

Upon actuation of the trigger 7 the pneumatic cylinder 9 is supplied with compressed air which is under the working pressure and after the trigger 7 is released the pneumatic cylinder 9 is vented, in per se known manner, by virtue of the movement of the valve rod 8.

Arranged at the bottom of the pneumatic cylinder 9 is a venting means which is generally indicated at 11 in FIG. 1.

Figure 2:
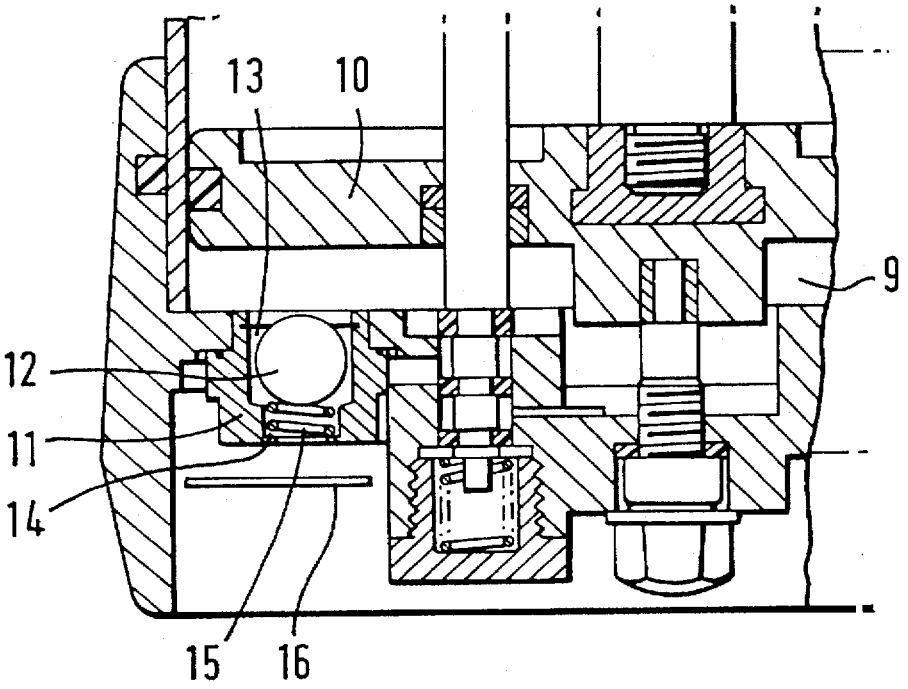
FIG. 2 is a view on an enlarged scale of the region of the rivet setting tool shown in FIG. 1, which includes the venting means.

Referring now also to FIG. 2, the venting means 11 includes a valve body 12 which is in the form of a ball disposed in a substantially cylindrical recess or opening 13. Adjoining the opening 13 in a coaxial direction is a recess or opening 14 which is also substantially cylindrical but which is of smaller diameter than the recess 13. The transitional region of the recess 14 to the recess 13 forms an annular sealing seat for the valve body 12. Disposed in the recess 14 is a coil spring 15 of defined hardness or with a defined spring constant, the spring bearing against an annular projection at the lower end of the cylindrical recess 14. Together the cylindrical recesses 13 and 14 form a direct communication between the pneumatic cylinder 9 and the exterior of the tool, that is to say ambient atmosphere.

Fixed beneath the venting means 11 is a cover or masking plate 16 disposed at a lateral spacing, relative to the bottom of the rivet setting tool.

The venting means 11 has a main body portion as indicated at 17 in FIG. 1. The body portion 17 is provided with a screwthread and at least one sealing surface which is associated therewith. The body portion 17 can thus be screwed into an opening in the pneumatic cylinder 9 so that the venting means 11 can be fluid-tightly fixed to the opening for the pneumatic cylinder 9.

When the pressure value in the tool falls below a predeterminable pressure limit value which is below the working pressure of the tool, the valve body 12 which is held by the force of the spring 15 in a condition of bearing upwardly against a retaining means illustrated in the form of a circlip provides a direct communication from the pneumatic cylinder 9 to the exterior of the tool.

When the pneumatic cylinder 9 is acted upon by the working pressure, in the rivet setting operation, the valve body 12 assumes its lower limit position, in opposition to the force of the spring 15, and fluid-tightly seals off the pneumatic cylinder 9 relative to the exterior of the tool.

Figure 3:
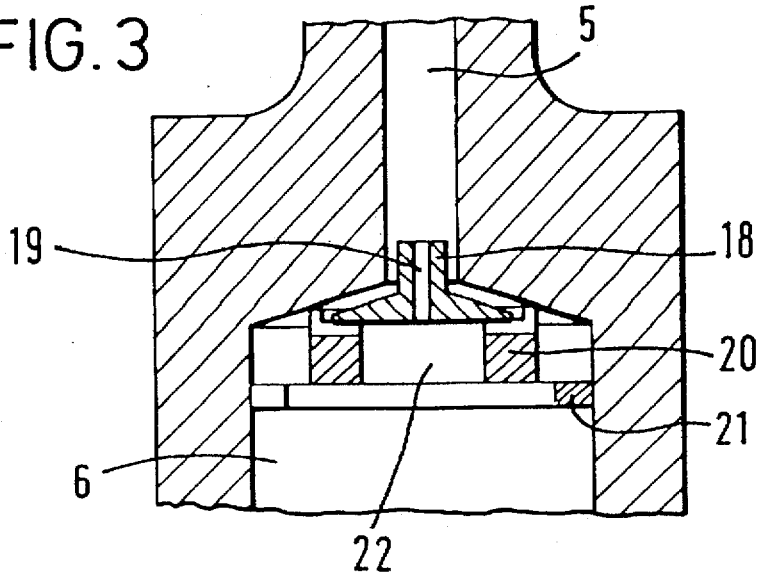
FIG. 3 is a view on an enlarged scale of the upper portion of the cylinder of the pressure piston with the valve body according to the invention, in cross-section.

Referring now further to FIG. 3, a further valve body 18 is arranged in the cylinder 6 of the pressure piston 2. The valve body 18 is of a substantially frustoconical configuration with a cylindrical projection portion thereon. As can be seen from FIG. 3 the valve body 18 is provided in the longitudinal direction with a bore 19 of a defined diameter extending therethrough. The cylindrical projection portion of the valve body 18 extends into the communication passage 5 at the outlet opening of the cylinder 6 and during the operation of pulling the pulling pin of a blind rivet member, is entrained by the flow of hydraulic oil into its upper limit position in such a way that it is essentially only the diameter of the bore 19 that is available as the effective internal width for a flow of hydraulic oil into the communicating passage 5. In the return movement of the pressure piston 2 and the working piston 3, the return flow of hydraulic oil flowing from the cylinder accommodating the working piston 3 towards the cylinder 6 accommodating the pressure piston 2 urges the valve body 18 out of the communicating passage 5 and into its lower limit position in which it bears against a rectangular cage 20.

The cage 20 has a through bore 21, the diameter of which is a multiple of the internal width of the communicating passage 5. Furthermore, hydraulic oil can flow laterally around and over the cage 20 so that essentially it is only the internal width of the communicating passage 5 that defines the flow resistance to the flow of hydraulic oil in the return movement of the pressure and working pistons 2 and 3 respectively.

The cage 20 is held in position in the tool by a retaining means illustrated in the form of a circlip 21. The circlip 21 can be used both with and also without an annular groove in the cylinder 6 as the forces to be carried by the cage 20 are small in comparison with the available holding forces of the circlip 21.

By virtue of the specific configuration described above the valve body 19 together with the cage 20 and the circlip 21 can also be subsequently fitted in a conventional rivet setting tool. In that respect the respective choice of the diameter of the bore 19 permits optimum adaptation to the desired speeds of operation involved in the rivet setting procedure.

It will be appreciated that the above-described embodiment of the tool according to the present invention has been set forth solely by way of example and illustration of the invention and that various modifications and alterations may be made therein without thereby departing from the scope of the invention.

What is claimed is:

1. A rivet setting tool for setting a blind rivet member with a pulling pin arranged for axial movement in a pulling direction during a setting operation of said blind rivet member, comprising:

an actuating arrangement operable for upsetting said blind rivet member by imparting an axial movement to said pulling pin, said actuating arrangement including:

a piston-cylinder arrangement comprising:

a first cylinder containing substantially incompressible fluid, a pressure piston movable in said first cylinder in a first direction for putting said substantially incompressible fluid under pressure and movable in a return direction opposite to said first direction, a pneumatic actuation device for actuating said pressure piston, a second cylinder, a working piston movable in said second cylinder in said pulling direction by said substantially incompressible fluid for imparting axial movement to said pulling pin during said rivet setting operation and movable in a return direction opposite to said pulling direction after said rivet setting operation, and a venting device for opening direct communication between said pneumatic actuation device and an exterior of said tool for escape of air from said pneumatic actuating device to said exterior of said tool during movement of said pressure piston and said working piston in their respective return directions.

2. A tool as set forth in claim 1 further including a spring device for moving said working piston in the return direction thereof.

3. A tool as set forth in claim 1 further including compressed air means for moving said working piston in the return direction thereof by force of compressed air.

4. A tool as set forth in claim 1, wherein said venting device includes a valve body for closing communication with said tool exterior at a working pressure within said pneumatic actuation device and for opening said communication with said tool exterior when pressure within said pneumatic actuation device falls below a predetermined pressure limit value.

5. A tool as set forth in claim 4, wherein said venting device includes a body portion having at least a first substantially cylindrical recess therein and an annular sealing surface at the bottom of said first cylindrical recess, said valve body comprises a ball located in said first cylindrical recess with a defined spacing relative to a cylindrical wall of said first cylindrical recess, and said venting device includes bias means at said bottom of said first recess for resiliently urging said ball away from said annular sealing surface.

6. A tool as set forth in claim 5 further including a second cylindrical recess of smaller diameter than said first cylindrical recess adjoining said first cylindrical recess, wherein said bias means comprises a coil spring disposed in said second cylindrical recess and adapted to press said ball towards a retainer at an end of said first cylindrical recess opposite said coil spring.

7. A tool as set forth in claim 5, wherein said body portion of said venting device has a screwthread and sealing surfaces associated with said screwthread for fixing said venting device fluid-tight to an opening to said pneumatic actuation device.

8. A tool as set forth in claim 1 further including a communication passage communicating between said first and second cylinders and a device for producing a difference between resistance to flow of said substantially incompressible fluid through said communication passage during movement of said working piston in said pulling direction and resistance to flow of said substantially incompressible fluid during movement of said working piston in the return direction thereof.

9. A rivet setting tool for setting a blind rivet member with a pulling pin arranged for axial movement in a pulling direction during a setting operation of said blind rivet member, comprising:

an actuating arrangement operable for upsetting said blind rivet member by imparting an axial movement to said pulling pin, said actuating arrangementincluding:

a piston-cylinder arrangement comprising:

a first cylinder containing substantially incompressible fluid, a pressure piston movable in said first cylinder in a first direction for putting said substantially incompressible fluid under pressure and movable in a return direction opposite to said first direction, a pneumatic actuation device for actuating said pressure piston, a second cylinder, a communication passage communicating between said first cylinder and said second cylinder, a working piston movable in said second cylinder in said pulling direction by said substantially incompressible fluid for imparting axial movement to said pulling pin during said rivet setting operation and movable in a return direction opposite to said pulling direction after said rivet setting operation, and a device for reducing resistance to flow of said substantially incompressible fluid through said communicating passage during movement of said working piston in said return direction thereof, wherein said device for reducing resistance includes a valve body operable during said return movement of said working piston to increase the internal width of said communication passage.

10. A tool as set forth in claim 9 further including a spring device for moving said working piston in said return direction thereof.

11. A tool as set forth in claim 9 further including compressed air means for moving said working piston in said return direction thereof by force of compressed air.

12. A tool as set forth in claim 9, wherein said valve body has a frustoconical main body with a cylindrical portion projecting therefrom and a bore extending at least substantially centrally in a longitudinal direction therethrough.

13. A tool as set forth in claim 9, wherein said valve body is held with axial clearance within said first cylinder in front of an outlet end thereof.

14. A tool as set forth in claim 9, further including a rectangular cage at an outlet end of said first cylinder having an at least substantially cylindrical opening and an axial through-bore, said valve body being disposed in said cylindrical opening in said rectangular cage.

* * * * *